US006668404B2

(12) United States Patent
Lanteri

(10) Patent No.: US 6,668,404 B2
(45) Date of Patent: Dec. 30, 2003

(54) ANATOMIC PILLOW

(76) Inventor: Jean-Bernard Lanteri, 14 Rue Paul Deroulede, Nice (FR), F-06000

( * ) Notice: Subject to any disclaimer, the term of this patent is extended or adjusted under 35 U.S.C. 154(b) by 0 days.

(21) Appl. No.: 10/169,776

(22) PCT Filed: Dec. 29, 2000

(86) PCT No.: PCT/FR00/03735

§ 371 (c)(1),
(2), (4) Date: Jul. 9, 2002

(87) PCT Pub. No.: WO01/50928

PCT Pub. Date: Jul. 19, 2001

(65) Prior Publication Data

US 2003/0000018 A1 Jan. 2, 2003

(30) Foreign Application Priority Data

Jan. 10, 2000 (FR) ..... 00.00306

(51) Int. Cl.[7] ..... A47G 9/00
(52) U.S. Cl. ..... 5/636; 5/638
(58) Field of Search ..... 5/636, 638, 632

(56) References Cited

U.S. PATENT DOCUMENTS

| | | | | | |
|---|---|---|---|---|---|
| 2,700,779 | A | * | 2/1955 | Tolkowsky | 5/632 |
| 2,835,905 | A | * | 5/1958 | Tomasson | 5/636 X |
| 3,239,854 | A | | 3/1966 | Freedlander | 5/636 |
| 3,312,987 | A | * | 4/1967 | Emery | 5/636 X |
| 3,667,074 | A | | 6/1972 | Emery | 5/636 |
| 3,757,365 | A | | 9/1973 | Kretchmer | 5/636 |
| 4,074,376 | A | * | 2/1978 | Bond | 5/632 |
| 4,118,813 | A | | 10/1978 | Armstrong | 5/638 |
| 4,147,825 | A | * | 4/1979 | Talalay | 5/636 X |
| 4,550,458 | A | * | 11/1985 | Fiore | 5/636 |
| 5,457,832 | A | * | 10/1995 | Tatum | 5/636 |
| 2002/0050007 | A1 | * | 5/2002 | Kim | 5/636 |
| 2003/0000018 | A1 | * | 1/2003 | Lanteri | 5/638 X |

FOREIGN PATENT DOCUMENTS

| | | | | | |
|---|---|---|---|---|---|
| AU | 211382 | A | * | 3/1956 | 5/636 |
| AU | 36813 | A | * | 1/1970 | 5/636 |
| GB | 1199533 | A | * | 7/1970 | 5/638 |

* cited by examiner

*Primary Examiner*—Robert G. Santos
(74) *Attorney, Agent, or Firm*—Young & Thompson

(57) ABSTRACT

A device for maintaining the body, for use as a pillow, includes at least one surface (1) for supporting the head and a central clearance (2) defining two side surfaces (3*a*, 3*b*) extending the support surface. The pillow has a length (L) not less than the body measurements of an adult user from the lower ribs to the ear, thereby adjusting the pillow support surface on the body in all positions of use.

20 Claims, 2 Drawing Sheets

ANATOMIC PILLOW

BACKGROUND OF THE INVENTION

The present invention relates to a device for supporting the body, usable as a pillow comprising at least one surface for supporting the head and a central recess defining two lateral surfaces in prolongation of the support surface.

The present device, in addition to its possible pillow function, could be employed for dorsal support in a seated position or else for supporting the back of the head, the neck or the nape of the neck in a position of relaxation.

It thus permits adapting itself to multiple conditions of use and constitutes as to that a physiological device.

Anatomical pillows already exist at present.

In this field, there is known from the document FR-A-2.732.572 an anatomical pillow with a general plane of symmetry of the type comprising an envelope forming a chamber for stuffing and comprising a projection having a general U shape, constituted by a transverse lower projection perpendicular to the plane, whose two ends are each prolonged by a lateral projection, the principal chamber forming a transverse projection, comprising an internal piece for cervical support, characterized in that said internal piece for cervical support has the shape of a semi-cylindrical profile in cross-section.

There is also known from the document WO A 98/07358 a pillow having a resistant and compressible body with an upper portion, a lower portion and a rounded lobe forming a protuberance at the lower portion. The pillow comprises a cutout portion in the rounded lobe adapted to receive the shoulder of the user. The pillow also comprises an incurved portion for the neck located between the upper portion and the lower portion.

This type of pillow comprises a generally rectangular shape seen from above, with an incurved portion at the center for the neck.

The pillow as shown in the document FR-2.732.572 comprises a central core which renders the pillow less homogeneous as to its mechanical characteristics and which increases the cost of production.

DESCRIPTION OF THE RELATED ART

It is moreover uniquely single faced. Also, its small dimensions are such that it permits support only for the nape of the neck. Its efficacy and the comfort of use are thus very limited.

As to the document WO A 98/07358, it has a very specific profile which is costly to produce.

Moreover, its thickness is great and it is less comfortable in use.

There is also known from U.S. Pat. No. 3,757,365 a pillow in the form of a substantially rectangular and flat block which comprises two zones of different resiliency according to its thickness.

So as to have a flexible lower layer avoiding problems of blood circulation in the arm of the user, this pillow compensates with a hard and uncomfortable upper layer. Moreover, the parallelepipedal rectangular thus constituted is too thick to match the shapes of the body in all the positions of use.

It offers support only at the level of the head.

As a result, present pillows do not give complete satisfaction particularly for users whose sleeping position is not on the back.

Thus, these pillows according to the prior art are not absolutely provided for other positions of sleep (particularly on the chest) or for relaxation.

Moreover, they have no arrangement for supporting the shoulders or the trunk or other parts of the body.

SUMMARY OF THE INVENTION

The present invention permits overcoming the drawbacks of present pillows.

Its first object is to permit great comfort of use and great flexibility of use by permitting several sleeping or relaxation positions.

It also has the advantage of making possible support of the shoulders when the user sleeps on the back, or support on the lower ribs when the user sleeps on his stomach, or again several possible supports when he sleeps on his side.

In this sense, the device in question is an invention which overcomes a prejudice according to which a pillow has for its sole object to serve to support the head and the vertebrae.

The invention also has the advantage of providing a device with homogeneous mechanical characteristics because it is preferably constituted of a single material and a single piece overall.

The choice of its dimensions and of its shape is moreover particularly so as to provide a position of the head which will always be centered on the pillow and hence permit good support of the head by taking best advantage of the vertical elasticity characteristics of the pillow.

The flexibility of use of the present device is further increased by making the latter symmetrical about a horizontal plane, which renders it useful on both sides.

Having thus the same characteristics on each side, the pillow can be turned over to use one surface that is fresher or warmer, for example.

Other objects and advantages will become apparent from the course of the description which follows, which is however not limiting of the invention.

The present invention relates to a device for supporting the body, usable as a pillow, comprising at least one surface for supporting the head and a central recess defining two lateral surfaces in prolongation of the support surface, characterized by the fact that its length is comprised between 65 and 90 cm corresponding to the mean measurement of adult individuals from the lower ribs to the ear, permitting adapting the support of the pillow over the body to all positions of use whose ventral position by support of the head and of the lower ribs on the lateral surfaces.

The pillow could take particular embodiments described hereafter:

- the lateral surfaces are inclined such that the thickness of the pillow decreases progressively toward their lower edge.
- the central recess has a curvilinear shape whose curvature is accentuated adjacent the two ends of said central recess.
- the minimum dimension about the profile is of the order of 30 cm.
- the central recess has a width of the order of 30 to 37 cm.
- its overall depth, from the lower edge of the lateral surfaces to the upper edge of the support surface, is comprised between 38 and 60 cm.
- it has a transverse profile of airplane wing shape with:
  - a central portion of maximum thickness,
  - a front portion of a thickness that decreases toward the lower edge of the lateral surfaces, a rear rounded portion.

it has a horizontal plane of symmetry.

it is constituted of a single piece and is pierced through its thickness with a series of holes, that are blind, each series of holes opening on one surface of the device, so as to define two more flexible regions in thickness, on opposite sides of a central harder region.

the upper edge is rounded to constitute a zone for supporting the head, the neck or the nape of the neck, in position on the back, for the relaxation of the muscles of the neck by stretching.

at least the central portion of the vicinity of the edge is harder than the rest of the support surface, to form a support region for the head, the neck and the nape of the neck that is harder.

the holes are of a diameter smaller adjacent a central portion of the length of the border, to form the harder support region.

BRIEF DESCRIPTION OF THE DRAWINGS

The accompanying drawings are given by way of indicative example and are not limiting. They show a preferred embodiment according to the invention. They permit easily understanding the invention.

DESCRIPTION OF THE PREFERRED EMBODIMENTS

There will now be described the present device in the field of use of a pillow. As already indicated, it is however applicable to other uses.

Figure 2:
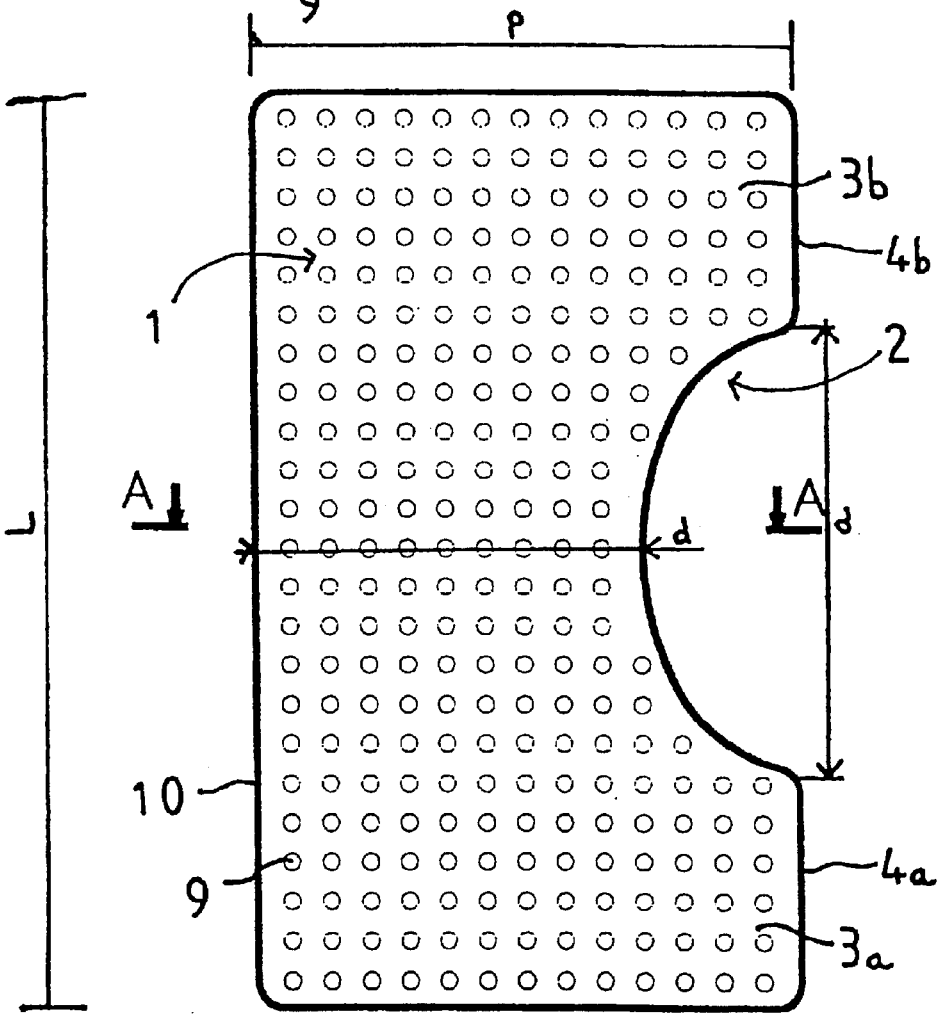
FIG. 2 is a plan view of the assembly of the pillow according to the invention.

As shown in FIG. 2, the anatomical pillow according to the invention comprises at least one surface indicated 1 for supporting the head and a central recess indicated 2 defining two lateral surfaces 3*a*, 3*b* in prolongation of the support surface 1.

For ease of description, there will be called L the length of the pillow and p its depth.

Figure 3:
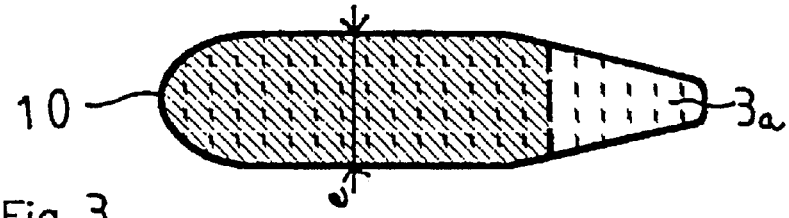
FIG. 3 is a cross-sectional view of the anatomical pillow at the level of the central recess, according to FIG. 2.

Moreover, as shown in FIG. 3, the maximum thickness of the pillow is indicated at e.

According to the invention, the length L of the pillow is at least equal to the measurement of the user from the lower ribs to the ear, for an average adult.

On the average, this measurement is of the order of 50 cm for an adult person.

When the user sleeps on the back or on the stomach, the body of the user is supported not only at the head but also at the shoulders and the lower ribs for the position on the stomach.

Only a pillow of the length provided by the invention permits achieving this result.

The support of the shoulders takes place at the level of the lateral surfaces 3*a*, 3*b* and avoids any fracture of the cervical vertebrae.

When the user sleeps on his stomach, he can be supported on the pillow not only by his head but also by his ribs, down to the lower ribs.

The user is thus perfectly supported in position on his stomach, which avoids any tendency to twist which would decrease his comfort and poorly supported his spinal column.

For use in sleeping on the side, the central recess 2 has for its function to permit the passage of the shoulder, avoiding interruption of support at the level of the vertebrae.

Given the mean measurements of adult individuals, the length L could be comprised between 65 and 90 cm.

In this way, the pillow could be suitable for a great portion of the public and provide support over a large portion of the body.

For good placement of the lateral surfaces 3*a*, 3*b* under the shoulders or under the ribs of the user, these surfaces 3*a*, 3*b* are inclined such that the thickness of the pillow decreases progressively toward their lower edge 4*a*, 4*b*.

Figure 1:
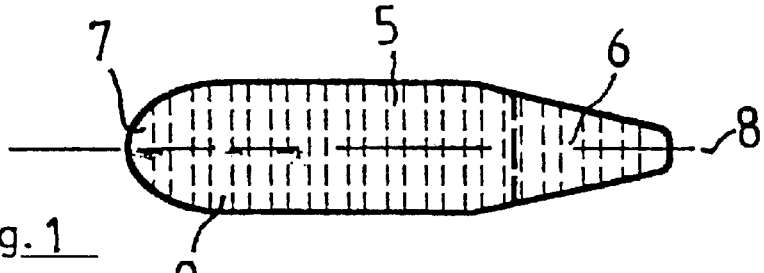
FIG. 1 is a side view.

This progressive decrease is shown in FIGS. 1 and 3.

It is linear here, but the curvature of the lateral surfaces 3*a*, 3*b* could be different.

The width (a) of the recess 2 could be comprised between 30 and 37 cm to adapt to the width of the shoulders of an average user.

The recess 2 could have a substantially circular profile at least over a portion of its periphery, as shown in FIG. 2.

In this way, by selecting a minimal dimension indicated at d about this profile, it is possible to ensure support of the head always in the center of the pillow.

It is thus at this position, that the characteristics of vertical elasticity of the pillow are the best.

For example, this central position of the head avoids any tendency to twist the head beyond the pillow, which could give rise to fatigue in the cervical vertebrae.

Figure 5:
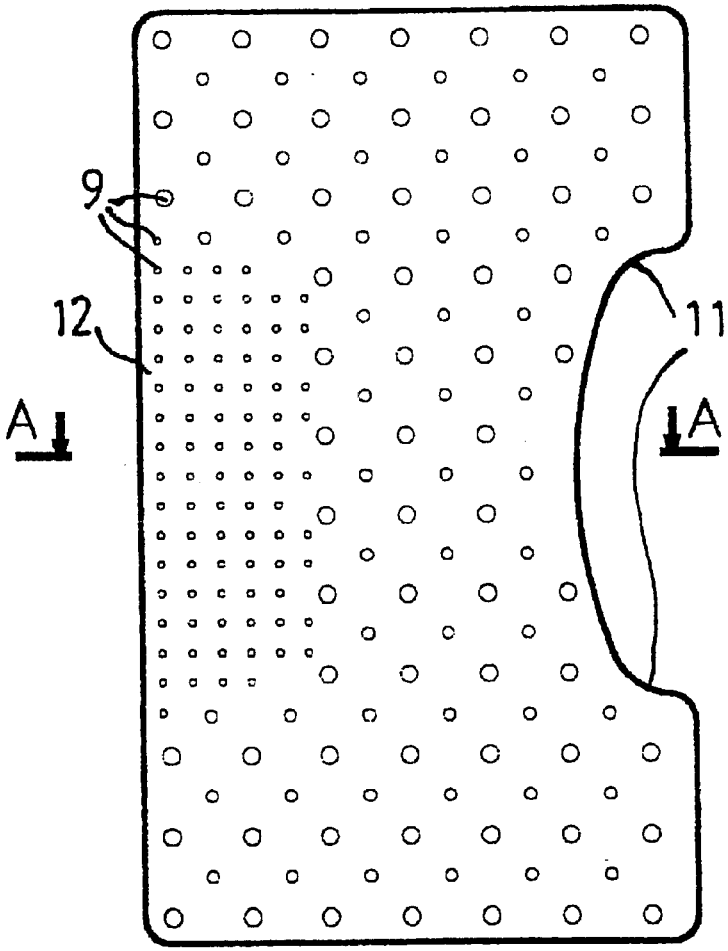
FIG. 5 is an assembly view of the pillow according to a second embodiment.

According to another modification shown in FIG. 5, the recess 2 has a profile which is curvilinear but non-circular and defines two more incurved regions 11 adjacent the two ends of the recess 2.

In this way, the most incurved regions 11 ensure wedging of the shoulder.

For example, a profile in the form of a half ellipse (cut along its greater axis) is usable.

In a preferred embodiment, the dimension d is of the order of 30 cm, which takes account of the average measurements of adult users for the distance shoulder/ear (about 15 cm).

Again in a preferred manner, the anatomical pillow has an overall depth (p) comprised between 38 and 60 cm.

This depth (p) is thus sufficient that the head will always be wedged on the support surface 1.

Moreover, the pillow could have a transverse profile of airplane wing shape as shown in FIG. 1.

According to this configuration, it comprises substantially three portions constituted by:

a central portion 5 of maximum thickness indicated at e where preferably the support of the head is provided, a front portion of decreasing thickness so as to provide inclined lateral surfaces, a rear portion permitting rejoining the support surface 1 of the lower surface of the pillow particularly about a rounded profile.

The thickness e could be comprised between 8 and 15 cm.

The two surfaces of the central portion 5 could constitute two opposite support surfaces 1. Preferably, these surfaces are flat.

It will be particularly advantageous to produce a pillow according to the invention that is symmetrical about a horizontal plane whose direction is indicated at 8 in FIG. 1.

On the one hand, this symmetry has the advantage of permitting more standardized production of the pillow. On the other hand, it permits a use of the latter by constituting two support surfaces 1 on the top and on the bottom of the pillow.

In a preferred embodiment, the pillow is constituted of a single piece and is pierced through its thickness with holes 9 shown from above in FIG. 2 and in front or cross-sectional view in FIGS. 1 and 3.

These holes are oriented vertically and distributed so as to adjust the mechanical characteristics according to the wishes of the user.

By making their diameters and/or their density vary, there is thus obtained a more or less flexible pillow more or less adapted to be bent.

Moreover, the holes aerate the pillow.

Figure 4:
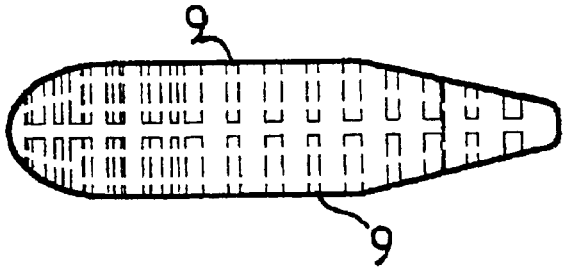
FIG. 4 is a side view of FIG. 5.
Figure 6:
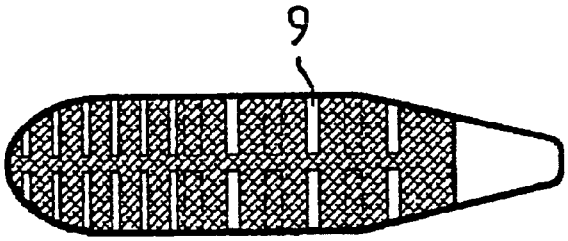
FIG. 6 is a cross-sectional view on lines A—A of FIG. 5.

FIGS. 4 and 6 show the formation of two series of blind holes. One series opens on the surface of the pillow, the other series on the other surface.

Preferably, the holes are all of the same depth. The central region, in the heart of the pillow, is reserved. Without holes, this region is harder.

In this way, the contact of the pillow is soft without the head sinking too deeply into the pillow.

By way of example, there could be made an anatomical pillow of a single piece according to the invention of a material with good elastic properties and particularly of latex.

The pillow as set forth above, by its configuration and a choice of particular dimensions, ensures comfort and effective support of the body of the individual no matter what the sleeping position.

Moreover, in the position on the stomach, the side surfaces 3*a*, 3*b* produce a rotation of the dorsal vertebrae.

It should be remembered that the rotation of the head takes place functionally or physiologically by a pre-rotation of the dorsal vertebrae and then of the cervical vertebrae.

If a young person is capable of turning the vertebrae by 90° without intervention of the dorsals, another older person uses the dorsal and cervical column. Hence the interest of dorsal pre-rotation (thanks to the lateral surfaces 3*a*, 3*b*, which can be inclined).

Thus, the cervical column is thus subjected to no more than a rotation of the order of 35 to 45°, which decreases the tension in the position on the stomach.

In the position on the side, the lateral surfaces (3*a*, 3*b*) elongate the line of position of the pillow and hence increase the number of possible positions of the head.

In addition to its pillow function, the present device can be used for other purposes.

There should be noted the upper border 10, particularly when it is of rounded shape, as is the case in FIGS. 1 and 3.

In this connection, the user in position on the back can rest his head at the level of the upper edge 10, thereby compressing it.

There results a stretching of the muscles of the neck, which is particularly relaxing.

This use of the device according to the invention can be applied to a sleeping position but also to a rest position for seated users, particularly in front of computer screens. Efficacious relaxation takes place because of several periodic stretchings.

To increase this stretching, the edge 10 is preferably harder than the rest of the device.

To this end, the holes present in its vicinity are either fewer in number, or smaller than before, as shown in FIG. 5.

It is essentially with respect to the central recess 2, in the central region with the possibility of the edge 10, in which is formed this support region 12 which is harder.

The present device can also serve as a cushion for dorsal support of the user in a seated position.

Placed at the level of the back, the device thus matches the bottom of the back. Its length and the central recess give rise to a slight bending of the lateral surfaces. The device thus perfectly wedges the bottom of the back (behind and against the ribs) without troubling the user (particularly, the top of the back remains free, thanks to the recess 2).

What is claimed is:

1. Device for supporting the body, usable as a pillow, comprising:

at least one support surface (1) for supporting the head; and a central recess (2) along a longitudinal edge of the support surface defining two lateral surfaces (3*a*, 3*b*) in prolongation of the support surface (1), wherein, a length (L) of the support surface is between 65 and 90 cm corresponding to the mean measurement of adult individuals from the lower ribs to the ear, and the central recess (2) has a width (a) of the order of 30 to 37 cm and a curvilinear profile whose curvature is accentuated adjacent the two ends of said central recess.

2. Device for supporting the body, usable as a pillow, according to claim 1, wherein, the two lateral surfaces (3*a*, 3*b*) are inclined such that the thickness of the pillow decreases progressively toward a lower edge (4*a*, 4*b*) of the of the lateral surfaces.

3. Device for supporting the body, usable as a pillow, according to claim 1, wherein, the minimum dimension about the profile is of the order of 30 cm.

4. Device for supporting the body, usable as a pillow, according to claim 2, wherein, the minimum dimension about the profile is of the order of 30 cm.

5. Device for supporting the body, usable as a pillow, according to claims 1, wherein, an overall depth (P) of the support surface, from a lower edge (4*a*, 4*b*) of the lateral surfaces (3*a*, 3*b*) to an upper border (10) of the support surface (1), is between 38 and 60 cm.

6. Device for supporting the body, usable as a pillow, according to claims 2, wherein, an overall depth (P) of the support surface, from a lower edge (4*a*, 4*b*) of the lateral surfaces (3*a*, 3*b*) to an upper border (10) of the support surface (1), is between 38 and 60 cm.

7. Device for supporting the body, usable as a pillow, according to claims 3, wherein, an overall depth (P) of the support surface, from a lower edge (4*a*, 4*b*) of the lateral surfaces (3*a*, 3*b*) to an upper border (10) of the support surface (1), is between 38 and 60 cm.

8. Device for supporting the body, usable as a pillow, according to claim 1, wherein, a transverse profile taken along the length of the support surface is an aircraft wing profile with a central portion (5) of a maximum thickness (e), a front portion (6) of thickness that decreases toward a lower edge (4*a*, 4*b*) of the lateral surfaces (3*a*, 3*b*), and a rear rounded portion (7).

9. Device for supporting the body, usable as a pillow, according to claim 2, characterized by the fact that it has a transverse profile like an aircraft wing with:

a central portion (5) of maximum thickness (e)

a front portion (6) of thickness that decreases toward the lower border (4*a*, 4*b*) of the lateral surfaces (3*a*, 3*b*)

a rear rounded portion (7).

10. Device for supporting the body, usable as a pillow, according to claim 3, wherein, a transverse profile taken along the length of the support surface is an aircraft wing profile with a central portion (5) of a maximum thickness (e), a front portion (6) of thickness that decreases toward a lower edge (4*a*, 4*b*) of the lateral surfaces (3*a*, 3*b*), and a rear rounded portion (7).

11. Device for supporting the body, usable as a pillow, according to claim 5, wherein, a transverse profile taken along the length of the support surface is an aircraft wing profile with a central portion (5) of a maximum thickness (e), a front portion (6) of thickness that decreases toward the lower edge (4*a*, 4*b*) of the lateral surfaces (3*a*, 3*b*), and a rear rounded portion (7).

12. Device for supporting the body, usable as a pillow, according to claim 1, being symmetrical about a horizontal plane (8).

13. Device for supporting the body, usable as a pillow, according to claim 1, comprised of a single piece and, along a thickness, pierced with plural series of blind holes (9), each series of holes opening in a face of the device, so as to define two more flexible zones in the thickness, on opposite sides of a harder central zone.

14. Device for supporting the body, usable as a pillow, according to claim 1, comprising an upper edge (10) rounded to constitute a support region (10) for the head, for the neck and for the nape of the neck, in position on the back, for the relaxation of the muscles of the neck by stretching.

15. Device for supporting the body, usable as a pillow, according to claim 14, wherein, at least a central portion of the region of the edge (10) is harder than the rest of the support surface (1), to form a support region (12) for the head, for the neck and for the nape of the neck, that is harder than adjacent regions.

16. Device for supporting the body, usable as a pillow, according to claim 15, along a thickness, pierced with plural series of blind holes (9), each series of holes opening in a face of the device, wherein, the holes (9) are of a smaller diameter adjacent at least the central portion of the edge than the diameter of adjacent holes, to form the support zone (12) that is harder.

17. An anatomical pillow, comprising:

a pillow body with a head supporting surface, the body having a length between 65 and 90 cm, a maximum width, a minimum width, and a non-constant thickness; and a central recess located intermediate two lateral edges (3*a*, 3*b*) along a lengthwise edge of the body, wherein, in a body profile transverse the length of the body, the thickness of the body is symmetric about a horizontal line and has a maximum thickness in a central portion of the profile and decreases progressively toward the lateral edges, the recess has a width, along the length of the body, between 30 and 37 cm, the recess has a curvilinear profile merging into the lateral edges through two curvilinear end parts that accentuated each profile end, the minimum width of the body is found at the recess and is of the order of 30 cm, the maximum width of the body is between 38 and 60 cm, and the maximum thickness is between 8 and 15 cm.

18. The pillow of claim 17, wherein, the body is pierced with holes, the holes are distributed along the body profile to adjust mechanical characteristics of the body.

19. The pillow of claim 18, wherein, the holes are blind holes, and the body is free of holes along the horizontal line of the body profile.

20. An anatomical pillow, comprising:

a single piece pillow body with a supporting surface, the body having a lengthwise edge length between 65 and 90 cm, a maximum width between 38 and 60 cm, a minimum width of 30 cm, and a non-constant thickness with a maximum thickness between 8 and 15 cm; and a central recess located intermediate two lateral edges (3*a*, 3*b*) along a lengthwise edge of the body, wherein, the recess has a width, along the length of the body, between 30 and 37 cm, in a body profile transverse the length of the body, the thickness of the body is symmetric about a horizontal line and has a maximum thickness in a central portion of the profile and decreases progressively toward the lateral edges, in plan view, the recess has a curvilinear profile merging into the lateral edges through two curvilinear end parts that accentuated each profile end.

* * * * *